US009573240B2

(12) United States Patent
Cloutier

(10) Patent No.: US 9,573,240 B2
(45) Date of Patent: Feb. 21, 2017

(54) HONING TOOL HOLDER WITH INTEGRAL IN-PROCESS FEED SYSTEM

(75) Inventor: Daniel R. Cloutier, Clive, IA (US)

(73) Assignee: Sunnen Products Company, St. Louis, MO (US)

( * ) Notice: Subject to any disclaimer, the term of this patent is extended or adjusted under 35 U.S.C. 154(b) by 538 days.

(21) Appl. No.: 13/825,389

(22) PCT Filed: Sep. 21, 2011

(86) PCT No.: PCT/US2011/052595

§ 371 (c)(1),
(2), (4) Date: Mar. 21, 2013

(87) PCT Pub. No.: WO2012/040354

PCT Pub. Date: Mar. 29, 2012

(65) Prior Publication Data

US 2013/0178138 A1 Jul. 11, 2013

Related U.S. Application Data

(60) Provisional application No. 61/384,947, filed on Sep. 21, 2010.

(51) Int. Cl.

| | |
|---|---|
| ***B24B 33/10*** | (2006.01) |
| ***B24B 33/02*** | (2006.01) |
| ***B24B 33/06*** | (2006.01) |
| ***B24B 5/08*** | (2006.01) |

(52) U.S. Cl.

CPC ..... *B24B 33/105* (2013.01); *B24B 5/08* (2013.01); *B24B 33/02* (2013.01); *B24B 33/06* (2013.01)

(58) Field of Classification Search

CPC ..... B24B 5/08; B24B 49/00; B24B 51/00; B24B 33/105; B24B 33/02; B24B 33/06

USPC ..... 451/5, 8, 51, 61, 119, 120, 121, 123

See application file for complete search history.

(56) References Cited

U.S. PATENT DOCUMENTS

| | | | | |
|---|---|---|---|---|
| 1,945,045 A * | 1/1934 | Johnson | ..... | 451/1 |
| 2,309,485 A * | 1/1943 | Wallace | ..... | 451/481 |
| 2,445,277 A * | 7/1948 | Mitchell | ..... | 451/478 |
| 2,741,071 A * | 4/1956 | Calvert | ..... | B24B 33/06 451/150 |

(Continued)

OTHER PUBLICATIONS

K.-U. Paffrath and D. Biermann, Integration of a Honing Tool into a Combination Machining Center, Technical Paper found in Proceedings of FISITA 2010 World Automotive Congress, International Conference on Automobiles and Sustainable Mobility, 30.5-4.6 2010, Budapest, Hungary, digital veroffentlicht.

*Primary Examiner* — Monica Carter
*Assistant Examiner* — Marcel Dion
(74) *Attorney, Agent, or Firm* — Matthews Edwards LLC

(57) ABSTRACT

A honing tool holder that provides a capability for automatically feeding the honing elements or stones when in the bore of a work piece, and for automatically stopping the feeding when a particular condition such as a bore size, is reached, so as to enable use of an in-process adjustable feed honing tool in a machine tool, machining center, or the like, lacking a feed mechanism or system. The holder can also include apparatus to automatically prevent feed past a limit. Both the feed force and feed limit can be adjustable, including by simple movements of the tool holder by the machine tool.

19 Claims, 10 Drawing Sheets

(56) References Cited

U.S. PATENT DOCUMENTS

| | | | | | |
|---|---|---|---|---|---|
| 3,025,646 | A * | 3/1962 | Thompson | B23B 31/003 | 279/155 |
| 3,456,396 | A * | 7/1969 | Hunt | B24B 33/06 | 451/11 |
| 3,702,043 | A * | 11/1972 | Welbourn | B24B 33/022 | 451/213 |
| 4,035,959 | A * | 7/1977 | Vanderwal, Jr. | 451/23 | |
| 4,173,847 | A * | 11/1979 | Gehring | B24B 33/02 | 451/156 |
| 4,397,658 | A * | 8/1983 | Vanderwal, Jr. | 451/178 | |
| 5,297,905 | A * | 3/1994 | Schmidt | B23B 51/101 | 407/8 |
| 5,800,252 | A * | 9/1998 | Hyatt | 451/61 | |
| 6,074,282 | A * | 6/2000 | Schimweg | B24B 33/081 | 451/119 |
| 6,739,949 | B2 * | 5/2004 | Becksvoort et al. | 451/28 | |
| 7,070,491 | B2 * | 7/2006 | Becksvoort | 451/470 | |
| 7,371,149 | B2 * | 5/2008 | Cloutier et al. | 451/5 | |
| 2003/0054743 | A1 * | 3/2003 | Negley | B24B 33/105 | 451/465 |
| 2007/0298685 | A1 * | 12/2007 | Cloutier et al. | 451/5 | |
| 2010/0105292 | A1 * | 4/2010 | Nagel | B24B 33/02 | 451/8 |

* cited by examiner

HONING TOOL HOLDER WITH INTEGRAL IN-PROCESS FEED SYSTEM

This application is submitted under 35 U.S.C. 371 claiming priority to PCT/US2011/52595, filed Sep. 21, 2011, which application claims the benefit of U.S. Provisional Application No. 61/384,947, filed Sep. 21, 2010.

TECHNICAL FIELD

The invention relates generally to a honing tool holder, and more particularly, that is adapted for mounting in a rotatable spindle of a machine tool or machining center lacking a feed system, and is capable of holding and automatically operating an in-process adjustable feed honing tool for honing a work piece to a desired diameter or other characteristic.

BACKGROUND ART

U.S. Provisional Application No. 61/384,947, filed Sep. 21, 2010, is incorporated herein by reference in its entirety.

Machine tools and machining centers, hereinafter sometimes jointly referred to by the term "machine tool", including, but not limited to, milling machines and the like, include rotatable spindles configured for holding tools such as milling cutters, drills, reamers, and the like, for performing machining operations, such as but not limited to, milling, drilling, boring, and reaming. Such tools are typically removably held in the spindle by tool holders, which allow quickly changing the tools, for instance, by an automatic tool changing apparatus. Honing is a machining operation that can impart a much more precise size, shape, and finish to work piece bores, but many traditional honing tools require a feed mechanism or system for adjusting a feed position and/or feed force of honing elements, e.g., abrasive stones, of the tool, in process, as those elements are urged against the surface of a bore of a work piece for honing the bore. Known machine tools and machining centers lack the required feed system or mechanism, and thus the traditional in process adjustable feed honing tools have not been used on machine tools.

Several honing tools that have an in-process feed capability designed for use in machine tools lacking a feed system or mechanism, are known. Many machine tools have a through-the-spindle coolant delivery system, and it is known to use the pressure of this coolant to directly or indirectly force the honing elements or abrasive stones of the honing tool against the surface of the bore. Reference, Hyatt et al., U.S. Pat. No. 5,800,252, which discloses a honing tool designed for use in a machine tool having through-the-spindle coolant. By means of passages the coolant pressure is supplied directly to chambers behind the abrasive stones to provide direct force. However this type of tool allows each abrasive stone to feed independently, which has been found to lack an ability to reliably improve the roundness of a bore, which is often a goal of the honing process. In the traditional in-process adjustable feed honing tools, roundness is usually improved by having the honing elements or abrasive stones fed or moved by a single wedge element that keeps all of the honing elements or stones advancing or retracting in unison.

Reference also Becksvoort, et al., U.S. Pat. Nos. 6,739,949 B2, and 7,070,491 B2, which disclose an alternative to a traditional in-process adjustable feed honing tool, by having a wedge style feed element that is moved or fed by the pressure of coolant delivered through the machine tool spindle. However, neither these patents or Hyatt et al. discloses a manner of detecting when the honing operation has achieved the desired bore size. Typically, honing is done for a set period of time or some external means of in-process bore gauging is employed to determine when the desired bore size has been reached.

Reference also a 2010 technical paper, titled *Integration of a Honing Tool into a Combination Machining Centre*, by Paffrath and Biermann, which describes a "honing" tool for use in a machine tool. However, the disclosed tool is not a honing tool in the traditional sense. It consists of stones that are moved in the manner of a boring tool radially into the wall of a bore which requires significant rigidity and therefore is ill-suited to any bore except those that are very short relative to their diameter. In contrast, traditional honing tools are self supported in the bore by their honing elements or stones and possibly shoes that contact the bore in multiple angular locations, and the tools expand by changing diameter, which offers a significant advantage in the control of size and bore geometry.

None of the above referenced prior art discloses a manner of using traditional in-process adjustable feed honing tools on the spindle of a machine tool or machining center.

Thus, what is sought is a honing tool holder that provides a capability for automatically feeding the honing elements or stones when in the bore of a work piece, and for automatically stopping the feeding when a particular condition such as a bore size, is reached, to enable use of an in-process adjustable feed honing tool in a machine tool, machining center, or the like, lacking a feed mechanism or system.

SUMMARY OF THE INVENTION

What is disclosed is a honing tool holder that provides a capability for automatically feeding the honing elements or stones when in the bore of a work piece, and for automatically stopping the feeding when a particular condition such as a bore size, is reached, so as to enable use of an in-process adjustable feed honing tool in a machine tool, machining center, or the like, lacking a feed mechanism or system.

According to a preferred aspect of the invention, the honing tool holder includes a body having a mounting element for cooperatively mounting the tool holder on a spindle of a machine tool for rotation therewith about a rotational axis therethrough, and a tool holding element opposite the mounting element configured and operable for cooperatively holding a honing tool for rotation about the rotational axis. The tool holder additionally includes a feed system integral with and carried on the body, configured to connect or couple to a feed element of a honing tool held by the tool holding element, the feed system including a biasing element configured and operable to automatically exert a feed force against the feed element to urge honing elements of the tool radially outwardly relative to the tool, and a release mechanism configured and operable to automatically engage an element of the feed system to prevent the exertion of the feed force against the feed element until a predetermined condition occurs. As a non-limiting example, the predetermined condition can include initiation of rotation of the tool holder, and the release mechanism can comprise a centrifugal force operated mechanism such as a spring mechanism, that releases the biasing element upon rotation of the tool holder in a certain manner or at some minimum speed. As a non-limiting example for the biasing element, it can comprise one or more springs that exert the feed force when released.

As an advantage of the tool holder of the invention, adjustable feed type honing tools are interchangeable between a honing machine and another type of machine tool not specifically designed for honing, and not including a feed system, provided only that the non-honing machine has the required spindle tool mounting connections, such as but not limited to, a tapered collet, straight collet, locking mechanism, or the like. These type of tools typically incorporate apparatus for the even feeding of multiple honing elements, and thus the invention brings this capability to machine tools not including a feed system or mechanism usable for this purpose.

As another preferred aspect of the invention, the feed system includes an apparatus configured and operable to automatically prevent radial movement of the feed element of the honing tool past a limit. This apparatus is preferably adjustable, to allow varying the limit and the extent of the feeding of the honing elements. As one preferred embodiment, the apparatus can include an external element on the body movable relative thereto for performing the adjustment. This can include, but is not limited to, a nut or gear, that can be adjusted by moving the tool holder. Additionally, the feed force can be adjustable in a similar manner, or different manner, as desired.

As another preferred aspect of the invention, the apparatus or feed system can include a signal device automatically operable to output a signal when the feed element is at the limit. The signal can be outputted to an operator, or to the machine tool, such as, but not limited to, via a radio or optical signal, to initiate stoppage of the honing cycle or operation, commencement of another operation, or other desired action.

Figure 1:
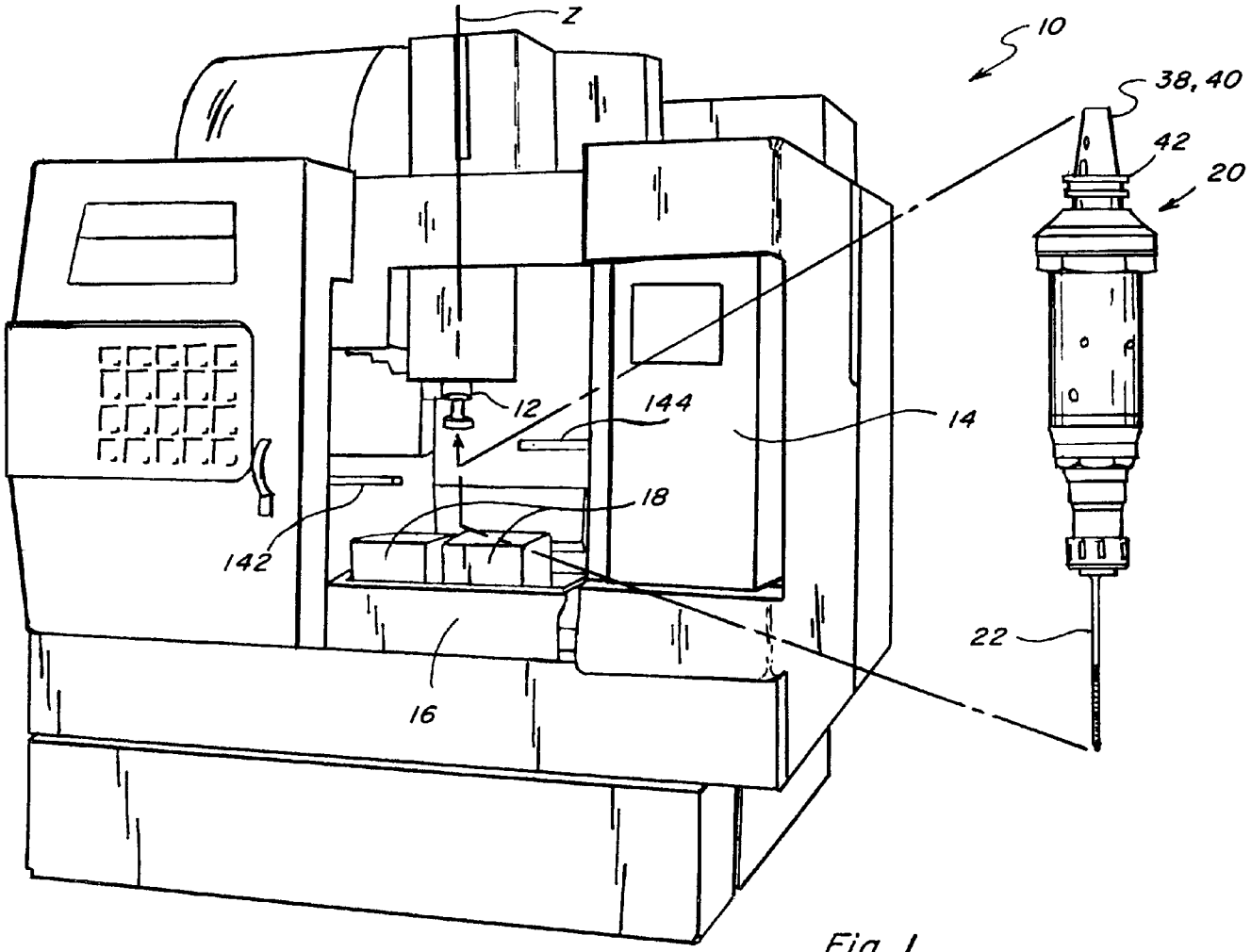
FIG. 1 is a perspective view of a representative machine tool and a honing tool holder of the invention for installation in a spindle of the machine tool, and showing a representative honing tool held in the holder.

DETAILED DESCRIPTION OF THE INVENTION referring now to the drawings, in FIG. 1, a conventional computer numerical control or "CNC" machine tool 10 is illustrated, including a vertical spindle 12 of well-known construction and operation. Spindle 12 is automatically controllably rotatable about a vertical rotational axis Z, and movable upwardly and downwardly along axis Z, by a controller 14 of machine tool 10, in the well-known manner. Machine tool 10 additionally includes a table 16 controllably movable horizontally along an X axis and a Y axis by controller 14, and configured and operable for supporting one or more or fixtures 18 for holding a work piece or work pieces on which work operations will be performed by machine tool 10. Controller 14 is of conventional construction and operation, and is a microprocessor controlled device automatically operable for executing a machining program for controlling spindle 12 and table 16 for performing the machining operations in the well-known manner. Such operations conventionally include, but are not limited to, milling, drilling, boring, reaming, threading, and the like. The respective operations are performed using tools specialized for the operations, which are held by tool holders insertable into and held by spindle 12, also in the well-known manner. Machine tool 10 will additionally usually include a tool changer (not shown) configured and operable for automatically inserting the respective tools into spindle 12 for commencement of operation, and removing of the tools after the operation is complete, also under control of controller 14. A honing tool holder 20 constructed and operable according to the teachings of the present invention, is illustrated as being insertable into spindle 12 for rotation and upward and downward movement thereby. Honing tool holder 20 is illustrated holding a honing tool 22. Here, it should be noted that although rotational axis Z is illustrated as a vertical axis, the present invention is also configured for operation and other orientations, including, but not limited to, a horizontal axis.

Figure 2:
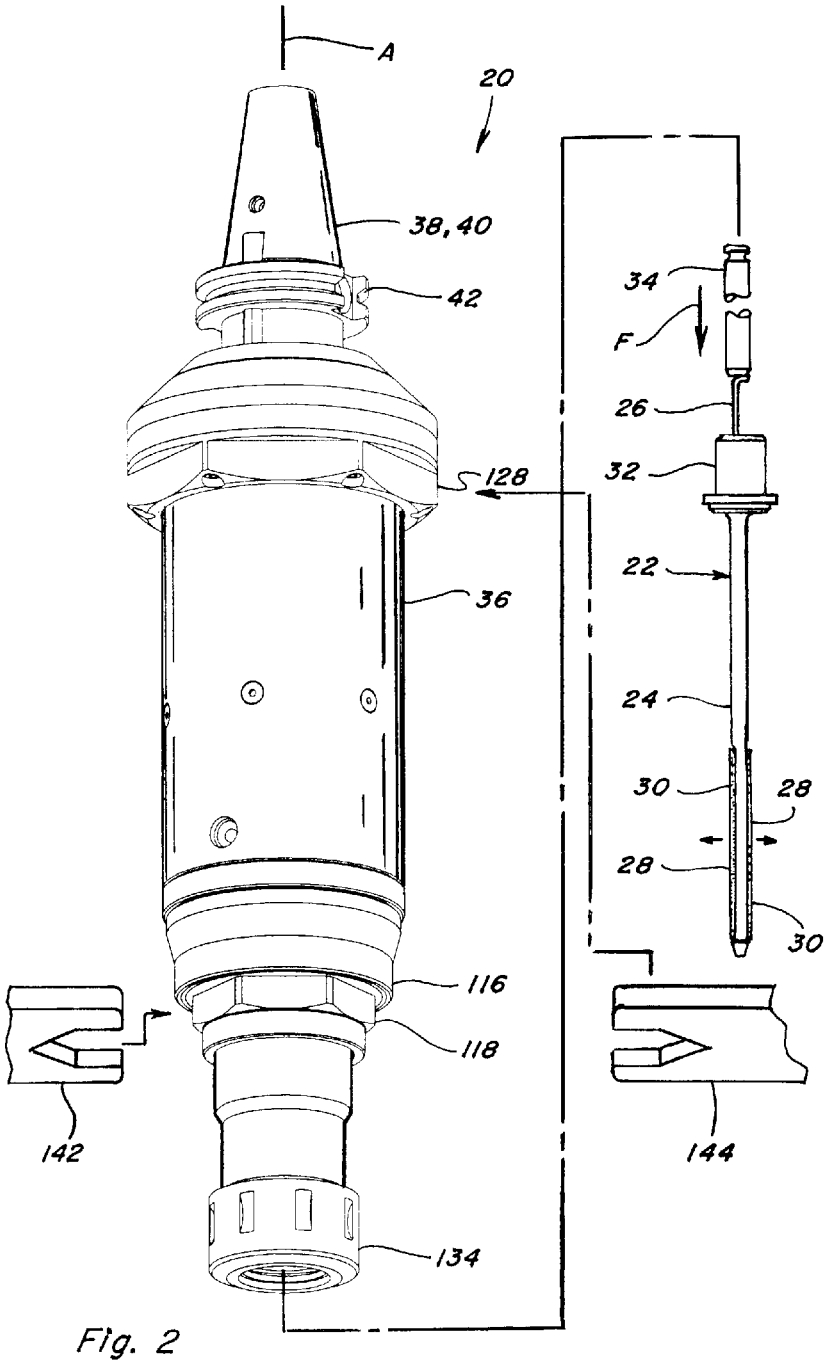
FIG. 2 is an enlarged perspective view of the honing tool holder of FIG. 1, showing the honing tool removed therefrom to reveal mounting and feed elements thereof.

Referring also to FIG. 2, honing tool 22 is representative of a wide variety of in-process adjustable feed honing tools including an elongate, hollow mandrel 24 which receives and carries a feed or wedge element 26 for longitudinal movement therein. Wedge element 26 has one or more wedge surfaces (not shown) located within mandrel 24 and which bear against mating wedge surfaces (also not shown) on honing elements 28 extending through slots 30 through the sides of mandrel 24 at angularly spaced locations thereabout. In operation, movement of wedge element 26 longitudinally into mandrel 24 (downwardly as depicted by arrow F in FIG. 2) will cause sliding relative movements of the wedge surfaces, which, in turn, will cause uniform radial outward movement or feed of honing elements 28, as denoted by the small arrows emanating radially from elements 28. Movement of the wedge element longitudinally outwardly relative to the mandrel (opposite of direction F) will allow the honing elements to radially retract. If in a work piece bore, once the honing elements are radially moved outwardly so as to contact the surface of the bore, application of a force in direction F against the wedge element, commonly referred to as a feed force, will act to transmit a radial outward force against the honing elements, which will be exerted against the surface of the work piece bore. The honing elements will comprise an abrasive substance, in the form of a stone or layer of abrasive particles, selected to achieve a desired honing or bore finishing effect, such as, but not limited to, a particular bore size, surface finish, trueness or concentricity, shape, or the like.

Honing tool 22, like many other in-process adjustable honing tools, has a mounting end 32 of a standard shape and size suitable for insertion into and retention by a standard tool holder such as a collet. At the same time, a wedge coupler 34 on the end of wedge element 26 is connectable to a feed rod of a feed mechanism located within the spindle of the honing machine and controllably movable in direction F and the opposite direction. In typical operation, at an appropriate time or times in the honing cycle or operation, the feed rod of the honing machine will be moved in direction F relative to the mandrel of the honing tool, to bring the honing elements into contact with the surface of the bore of a work piece in which the tool is located, and the feed force applied, during relative rotation and stroking of the tool and work piece, to effect honing the bore surface. Upon completion of a desired honing step or operation, the feed rod will be moved in the opposite direction, to remove the feed force and the tool can be withdrawn from the bore, or another honing operation performed.

Feed mechanisms similar to those of conventional honing machines as just described, are not present in the spindles of other machine tools, such as milling machines, machining centers, and the like, such as representative machine tool 10 illustrated. As a result, in-process adjustable feed honing tools such as tool 22 are normally not usable with a conventional, non-honing type machine tool or machining center such as machine tool 10.

Honing tool holder 20 remedies the above shortcoming, by including an integrated feed system which has a capability to both automatically initiate feeding of the honing elements, and stop the feeding when a limit is reached. Honing tool holder 20 also has the capability to automatically output a signal indicating the reaching of the limit, such that the honing cycle or operation can be halted, altered, or other step taken. FIGS. 1 and 2 show that the tool holder 20 has a relatively large body 36 including a mounting end 38 having a tapered shank 40 made to a standard connection specification (such as, but not limited to, CAT, HSK, etc.) so as to be installable in the manner of a conventional tool holder in the spindle of a machine tool or machining center not including a feed system or mechanism, such as spindle 12 of machine tool 10 which will have a matching collet for that purpose. Mounting end 38 of tool holder 20 additionally includes a flange 42 about mounting end 38 adjacent to tapered shank 40 and adapted for engagement with a conventional tool changer operable for installing and removing tool holder 20 from a spindle, such as spindle 12. When installed in a spindle, such as spindle 12, a central axis A of tool holder 20 will be coaxial with a rotational axis of the spindle (here, rotational axis Z), and tool holder 20 will be rotatable and movable upwardly and downwardly with the spindle.

Referring also to FIGS. 3 through 10 which show elements of tool holder 20, within the top of body 36, disposed within flange 42 and adjacent mounting end 38, are elements of a feed system 44 completely contained on tool holder 20 substantially within body 36 and configured to connect or couple to a feed element of a honing tool held by the tool holding element (here, wedge element 26 of honing tool 22 via connection with coupler 34). Feed system 44 includes a biasing element 46 configured and operable to automatically exert a feed force against the feed element (wedge element 26 of tool 22) via a feed rod assembly 100 (described in detail below) to urge honing elements 28 of the tool radially outwardly relative to the tool. Feed system 44 additionally includes a release mechanism 48 configured and operable to automatically engage an element of feed system 44 to prevent the exertion of the feed force against wedge element 26 until a predetermined condition occurs, which here is initiation of rotation of tool holder 20.

Figure 3:
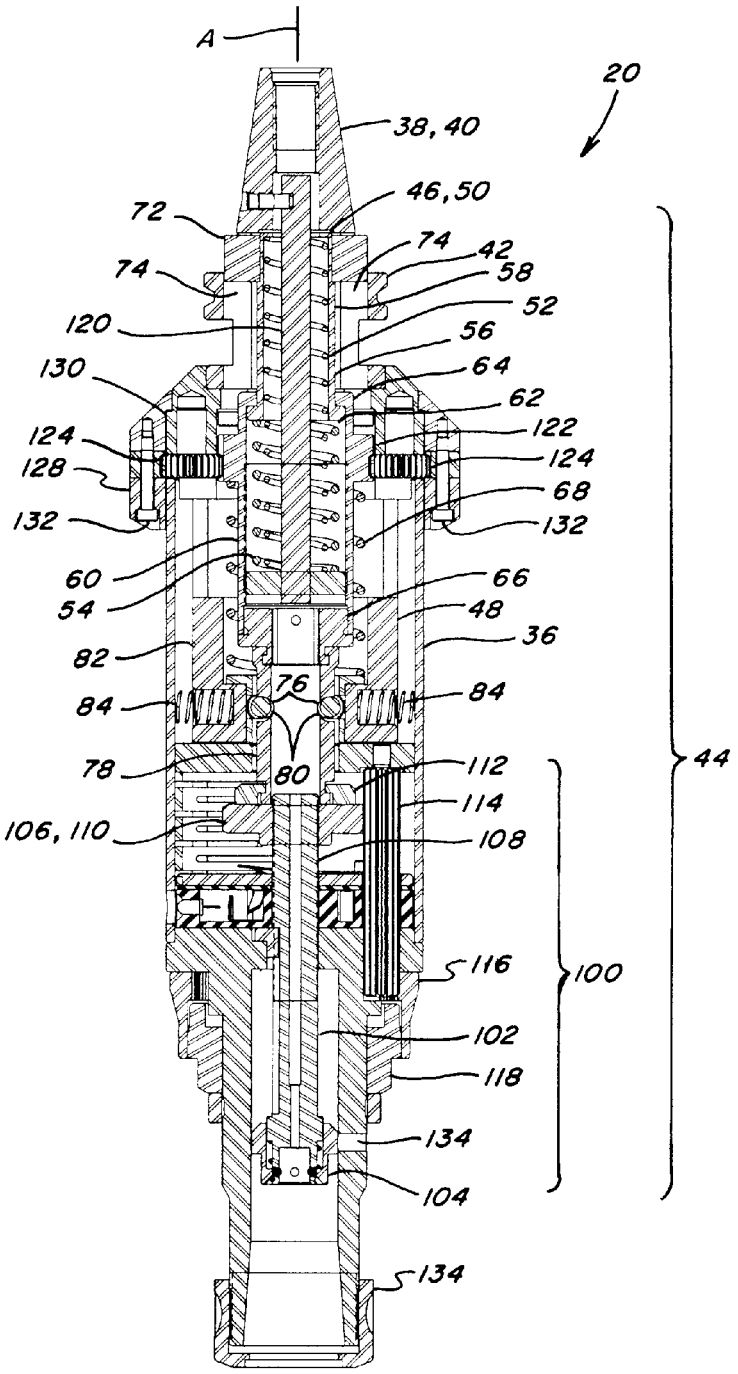
FIG. 3 is an enlarged sectional view of the tool holder, without a honing tool held therein, and in a non-preloaded state.
Figure 4:
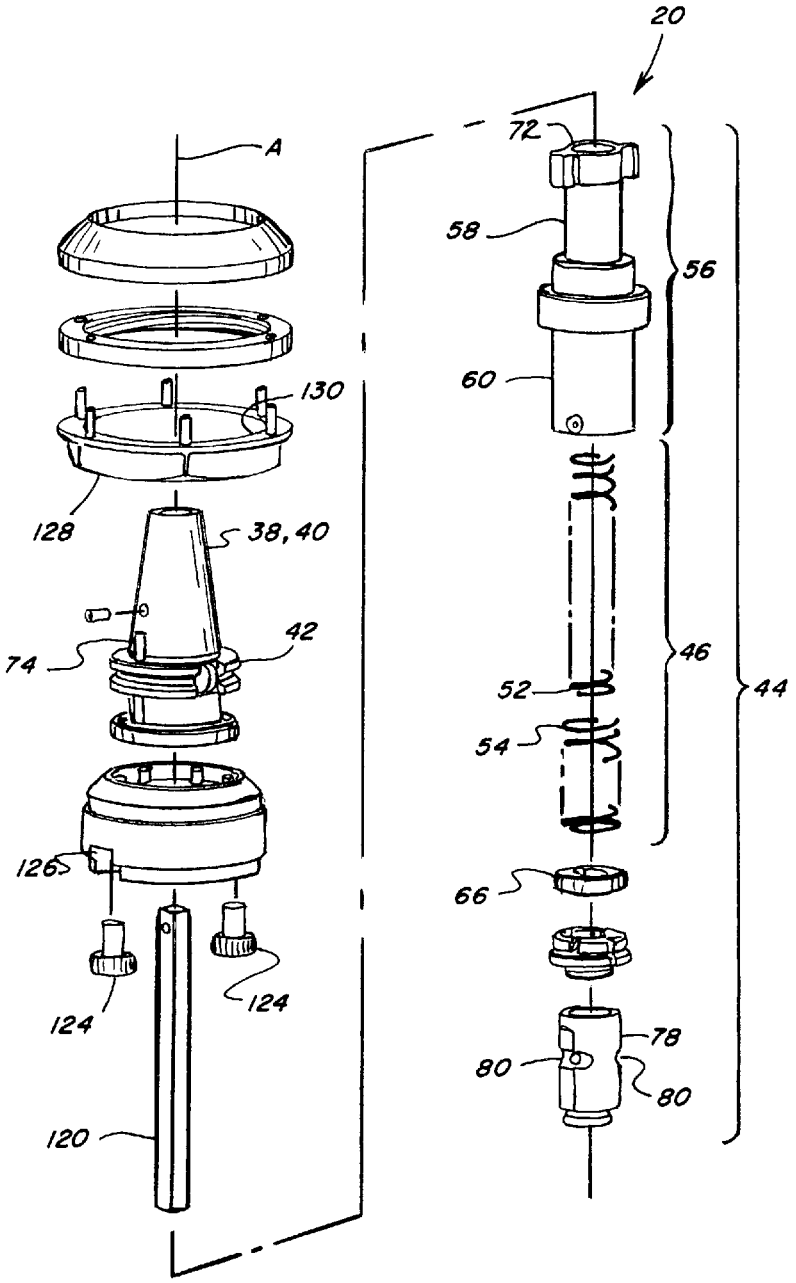
FIG. 4 is an exploded perspective view of upper elements of the tool holder.
Figure 5:
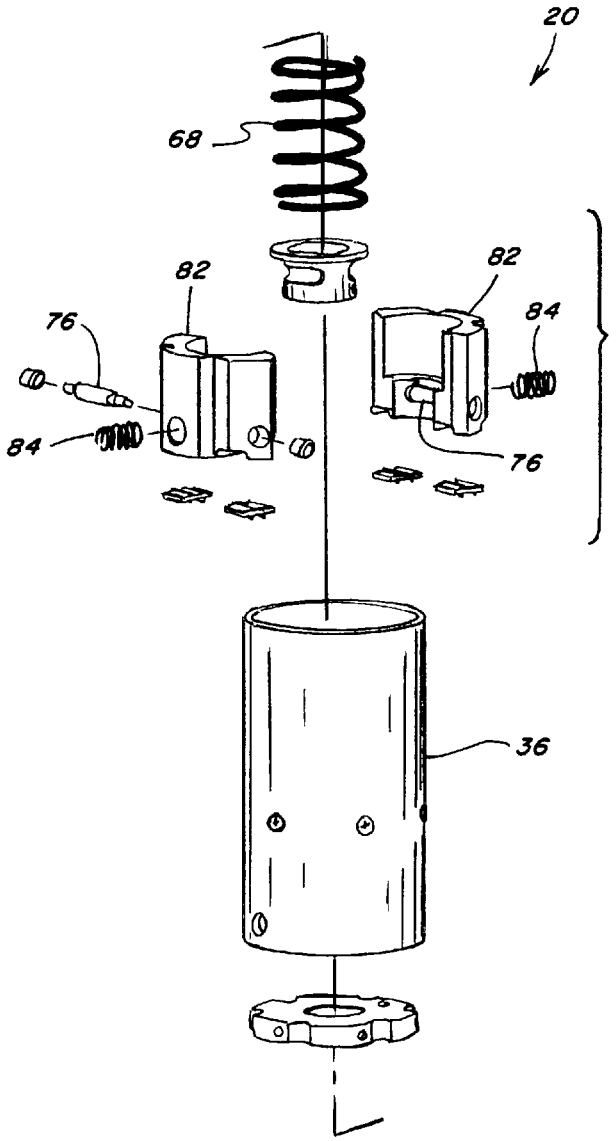
FIG. 5 is a continuation of FIG. 4, showing middle elements of the tool holder.
Figure 6:
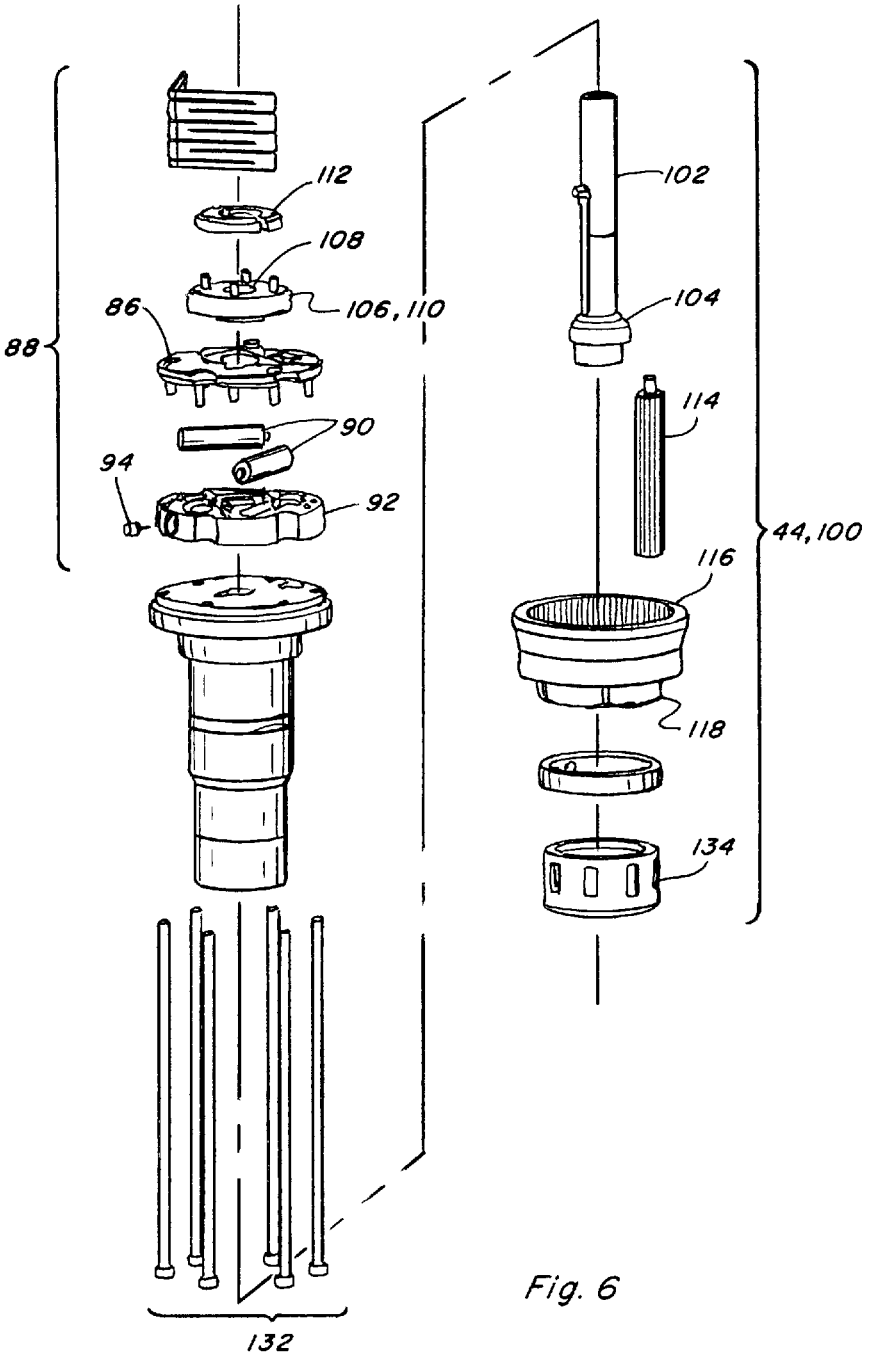
FIG. 6 is a continuation of FIGS. 4 and 5, showing lower elements of the tool holder.

Biasing element 46 of feed system 44 includes a feed spring assembly 50 which consists of coil springs 52 and 54 concentrically held in a telescoping housing 56 having inner and outer tubular pieces or segments 58 and 60. Mating lower and upper flanges 58 and 60 on these telescoping housing pieces cooperatively engage when tool holder 20 is not mounted in a spindle, to contain and limit the expansion of feed spring assembly 50. A lip or shoulder around the upper end of inner segment 58 retains the upper end of spring 52, and the upper end of spring 54 is retained by flange 62. Feed spring assembly 50 has a variable position spring retainer or seat 66 threaded on its outside diameter so as to be threadedly received in the bottom end of outer segment 60 of housing 56. This contains the lower ends of springs 52 and 54 and allows for adjustment of the feed force. In FIG. 3 (with the tool holder not installed in the machine tool spindle) the feed spring assembly 50 is thus limited to its full expansion. Therefore, even though there is some preload on springs 52 and 54, all of the spring force of those springs is restrained by flanges 62 and 64 being in contact. As a result, when tool holder 20 is not installed in a spindle, the feed force delivered via feed rod assembly 100 to the wedge coupler and honing tool is zero.

Although the embodiment of assembly 50 here shows utilization of two nested springs 52 and 54, it should be understood that it is contemplated that many options will be available. One or two springs, or more springs can be used, and the springs can have various spring rates and be of various constructions. One set of springs will probably not cover the wide range of feed force that may be needed to cover all applications. As a result, tool holder 20 is built with a certain limited range of feed force based on the springs selected for the spring assembly 50. It is contemplated that, with some disassembly these springs can be changed in the field to equip tool holder 20 with a different range of feed force if required or desired for a particular application.

Here, it should also be understood that the weight of the internal moveable components of tool holder 20, particularly, feed rod assembly 100, would by itself produce a feed force that would keep the honing tool mounted thereon from being retracted. To prevent this, a retraction spring 68 disposed about outer segment 60 of housing 56 resiliently holds the internal components in the retracted state shown in FIG. 3.

Figure 7:
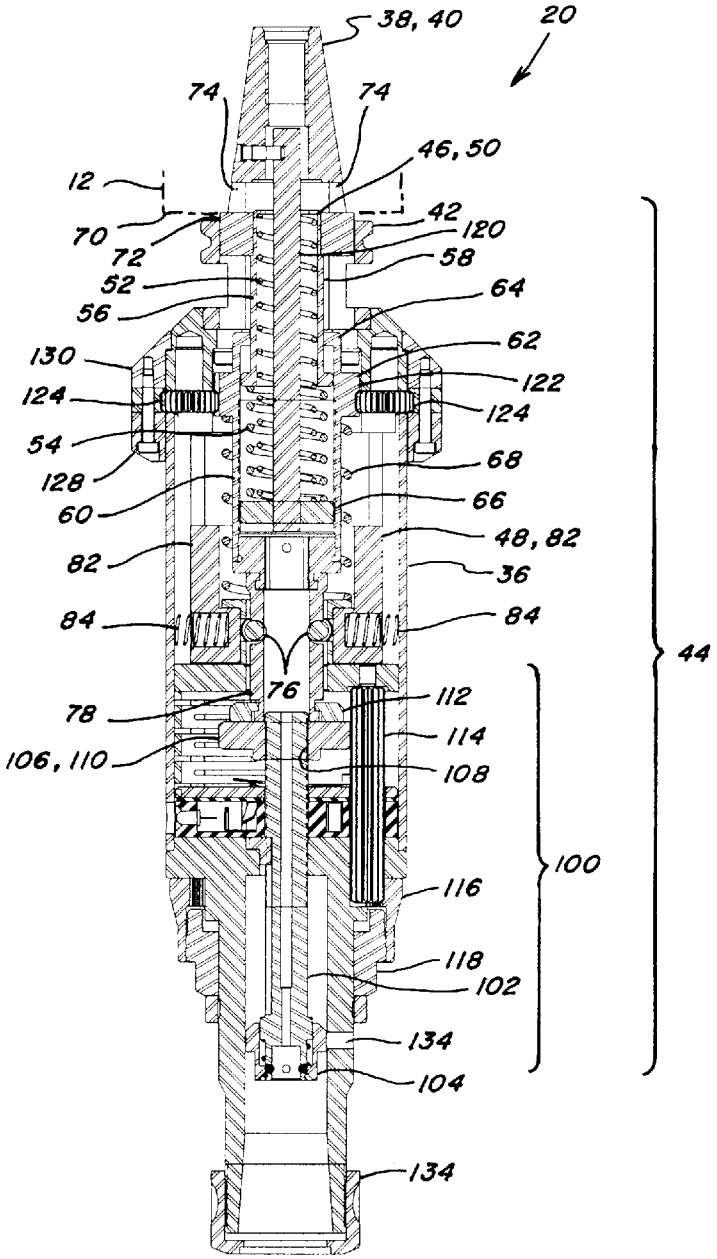
FIG. 7 is another enlarged sectional view of the tool holder, in a preloaded state representative of when installed in a spindle.

FIG. 7 shows tool holder 20 when installed in a machine tool spindle such as spindle 12. As tool holder 20 is installed in the spindle, a lower face 70 of the spindle will depress a feed force actuator 72 fixed about an upper end of inner segment 58 of housing 56 of spring assembly 50 and having radially outwardly extending ears located in slots 74 in tapered shank 40 but not flange 42. The upper end of feed force actuator 72 thus protrudes sidewardly from the tapered shank and is movable downwardly within slots 74 by the contact with the spindle to compress springs 52 and 54 beyond their preloaded state of FIG. 3. This also lets the spring force be transmitted to the components below (flanges 62 and 64 are no longer in contact). However, the spring force is still restrained from being transmitted via feed rod assembly 100 to the wedge coupler by release mechanism 48, as discussed next.

It can be observed in FIG. 3 that below feed spring assembly 50, release mechanism 48 includes a pair of restraining pins 76 that are received in grooves 80 in opposite sides of an upper feed rod 78 of feed rod assembly 100. This restrains axial movement of upper feed rod 78 and thus transmission of the feed force of the springs 52 and 54 through the feed rod assembly 100 to a honing tool held by holder 20. Restraining pins 76 are carried respectively in a pair of weights 82 of mechanism 48 that are urged radially inwardly toward and into grooves 80 by a set of intentionally weak restraining springs 84.

Figure 8:
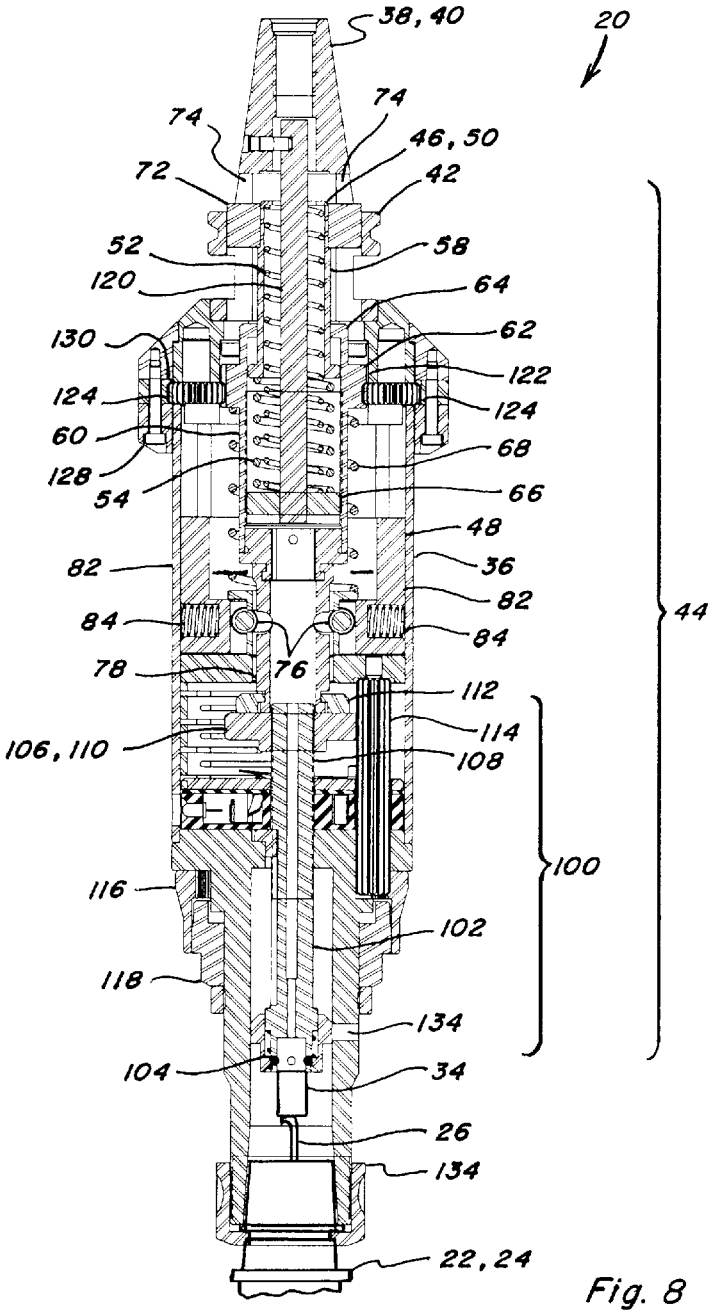
FIG. 8 is another enlarged sectional view of the tool holder, showing restraining apparatus of a feed system thereof in a released state.
Figure 9:
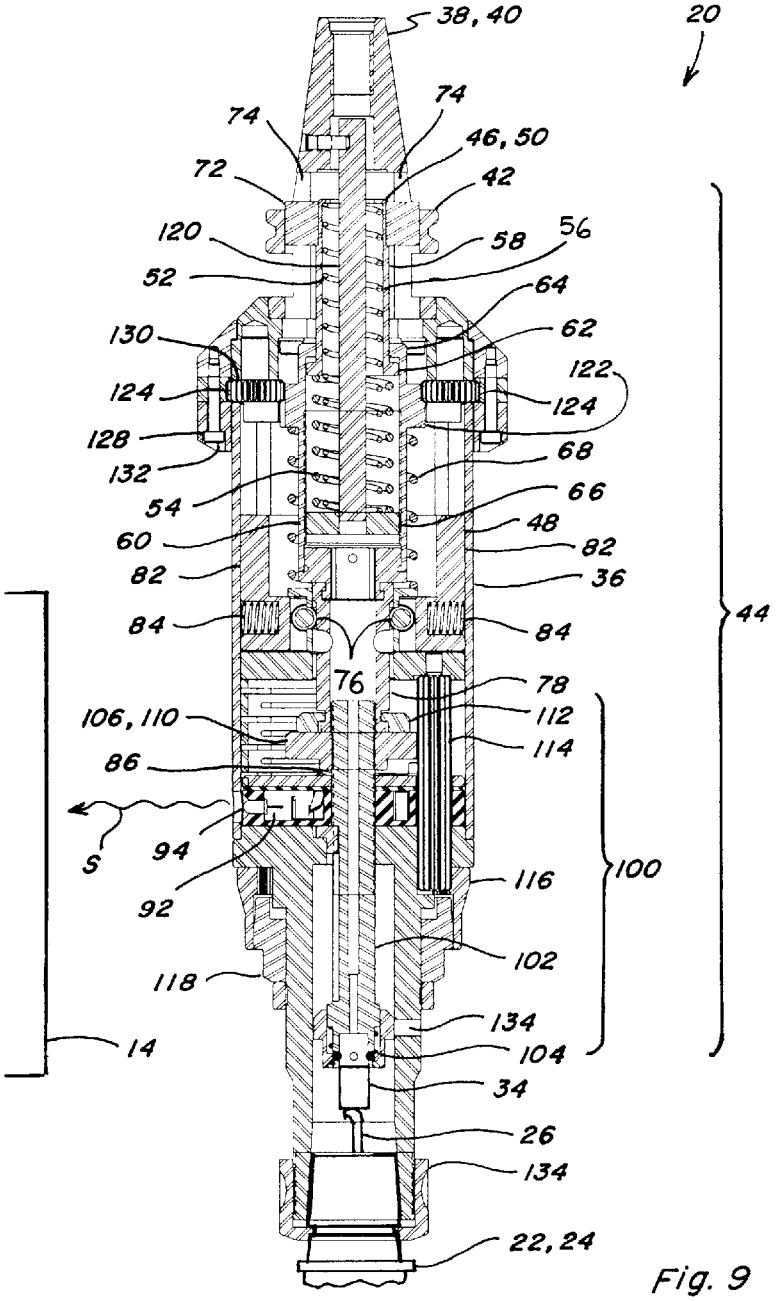
FIG. 9 is still another sectional view of the tool holder, showing elements of the feed system in contact with a limit, and illustrating outputting of a signal indicative thereof.

FIG. 8 shows tool holder 20 as the spindle rotation begins. By centrifugal force, weights 82 will move rapidly radially outwardly to the inner circumferential surface of body 36, as denoted by associated small arrows. Restraining pins 76 now clear grooves 80 in feed rod 78, and springs 52 and 54 are free to push the moveable internal components of feed spring assembly 50 down against feed rod assembly 100 and thus to the honing tool to commence feed motion, as illustrated in FIG. 9. Restraining pins 76 are mounted in bearings to minimize the centrifugal force (and hence the rotational speed) needed to overcome the friction of the members contacting weights 82. On the bottom side of the weights there are also preferably provided linear roller bearings to reduce friction. (The rollers and bearings cannot be seen in these FIGS.)

Figure 10:
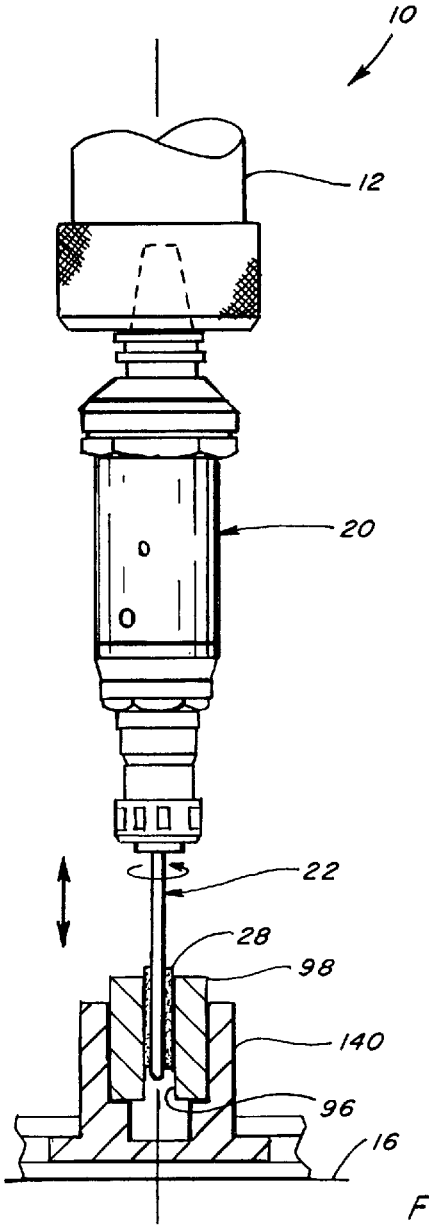
FIG. 10 is a simplified schematic side view of the tool holder of the invention, in operation holding a honing tool and stroking the tool in a bore of a work piece.

The feeding motion will progress downward as transmitted by feed rod assembly 100 while machine tool 10 rotates and strokes spindle 12 upwardly and downwardly, and with it, tool holder 20 with honing tool 22 in the bore 96 of a work piece 98 held on table 16 of machine tool 10, as illustrated in FIG. 10. The feeding motion in the tool holder reaches a point that a limit switch 86 is contacted as shown in FIG. 9 (here by a feed adjusting element 106 of feed rod assembly 100). Switch 86 is part of a sealed unit 88 located within body 36 and containing batteries 90, a circuit 92 and an LED 94 (see also FIG. 6), configured and operable for outputting a signal, denoted by arrow S, indicative of feed system 44 having reached a predetermined settable feed limit. When switch 86 is contacted by element 106 it closes the circuit 92 to provide power from batteries 90 to LED (and/or optionally an RF transmitter) to send the signal S to a receiver of, or in connection with, controller 14 of machine tool 10 as an indication that the final size and/or other characteristic of a bore 96 of a work piece 98 being honed (FIG. 10) has been reached. Controller 14 then stops the honing cycle, e.g., by stopping spindle rotation and by withdrawing honing tool 22 from the work piece bore, or performs some other programmed command.

When tool holder 20 is removed from spindle 12 to a tool changer or tool storage location (not shown), then feed force actuator 72 is no longer held depressed by the spindle face 70 and retraction spring 68 will cause upward retraction of feed rod assembly 100 of feed system 44, which will allow restraining pins 76 to once again engage upper feed rod 78, such that the feed assembly will be restrained in the position of FIG. 3. If tool holder 20 is desired to be used to hone multiple bores in succession, without removal from spindle 12, then a different embodiment of this tool holder can be provided where the reset of the feed can occur via some other controlled machine tool motion.

Bore Size and Feed Force Adjustment

The feeding motion of tool holder 20 will always stop in a consistent location relative to the tool holder. This coupled with the immediate response of controller 14 of machine tool 10 causes the honing process to always stop with the wedge element of a honing tool held by the holder in a consistent position which creates a repeatable honed bore size or other characteristic. To adjust this final honed size or other characteristic, and/or to adjust for the wear of the abrasive honing elements of the honing tool, feed rod assembly 100 (which here comprises upper feed rod 78, a lower feed rod 104, and feed adjusting element 106), within tool holder 20 must be lengthened or shortened. This is accomplished by means of the feed adjusting element 106 which has a threaded hole 108 therethrough which threadedly receives the upper end of lower feed rod 102 which is threaded for this purpose. Adjusting element 106 additionally has an adjusting gear 110 about its outer circumference, and a retaining flange 112 on its upper end. Gear 106 engages a pinion 114 that in turn engages a ring gear 116 at its lower end. Ring gear 116 is fastened to a feed position adjustment nut 118 rotatably disposed about the lower end of body 36, so that a measured turn of nut 118 will rotate ring gear 116 to rotate pinion 114, which in turn will rotate adjusting gear 110, to threadedly engage lower feed rod 102 to move it upwardly or downwardly within and relative to feed adjusting element 106. Adjusting element 106 is connected to upper feed rod 78, such that the upward and downward movement of lower feed rod 102 will also be relative to upper feed rod 78, so as to effectively shorten or lengthen feed rod assembly 100, which will translate to adjustment movements of a wedge element 26 coupled to lower feed rod 102 via coupler 104, which will adjust final bore size achieved by honing elements 28 of a tool held by holder 20.

In the setup and adjustment of a honing operation, the feed force applied to a wedge element of a tool held by holder 20 must often be adjusted and/or optimized. The feed force of tool holder 20 is generated by springs 52 and 54 of biasing element 46, which can be compressed to a greater or lesser degree to generate the feed force required. As discussed above, seat 66 is threaded into outer segment 60 of housing 56 of feed spring assembly 50. It is prevented from rotating by a keyed rod 120 that extends through the center of seat 66 and is fixed in shank 40 of the tool holder. Housing 56 has a gear 122 disposed about outer segment 60 that is engaged by smaller feed force adjustment gears 124 that protrude though slots 126 through the side of body 36. These protruding gears 124 can be turned to cause a rotation of housing 56 within and relative to body 36, which in turn will move seat 66 axially to compress or relax springs 52 and 54.

As a non-limiting example, the feed force adjustment can be automated by fastening a small segment of gear rack to a fixed location somewhere on a machine tool, such as on table 16 of machine tool 10 so that by a controlled motion of the table, one of adjustment gears 124 of the tool holder can be made to engage the rack and rotated by a controlled relative movement of the tool holder and rack by a required to effect a desired adjustment in the force. This can happen, for instance, as part of the honing process setup or at anytime in between honing cycles as directed by a machine control program or an operator.

As another non-limiting example, holder 22 can include a feed force adjusting nut 128 disposed for rotation about body 36, having an internal ring gear 130 engaged with gears 124, such that, rotation of nut 128 will effect rotation of gears 124 and the adjustment of the feed force in the above described manner. This can be accomplished by engagement of parallel surfaces of nut 128 with a pair of parallel planes 144 disposed at a suitable location adjacent to table 16, as shown in FIGS. 1 and 2, and controlled rotation of the tool holder (it should be noted here that parallel planes 144 are not shown to scale).

Honing tool holder 20 is preferably assembled in a suitable manner using appropriate fasteners, such as, but not limited to, screws 132, threaded rings, snap rings, and other common fasteners. This allows convenient access to batteries 90 and circuit 92, and to springs 52 and 54, for service and replacement.

Just above a collet nut 134 on tool holder 20, an access hole 136 is provided as one possible means for an operator to access and release coupler 104 to install or release a honing tool wedge coupler 34 of a honing tool.

Honing Process Control

In addition to the bore size and feed force feed adjustments that must be made by the means described above, the machine tool with which tool holder 20 is used must also be programmed for the reciprocating motion of a typical honing cycle. That programmed cycle must be allowed to continue until a signal is received from the transmitter on the tool holder, here LED 94, an RF device, or the like. Additionally, the program should include logic to stop a cycle after a maximum time has been reached as an indication that the abrasive of the honing tool are worn out or no longer in a condition to cut effectively.

The control program should also allow for bore size compensation as follows: A manually entered tool comp would adjust the tool size accordingly. A known approximate abrasive wear rate entered by the operator would result in an automatic adjustment of the tool by that amount before each honing cycle. An external gauging device (air gauge, or similar) could feed back information to the machine control system for purposes of adjusting tool size and possibly adjusting the stroke of the honing cycle.

The routine of adjusting the tool size should also include some programmed machine motions. For example, the tool holder can be brought into engagement with a set of parallel planes 142 located at an accessible location on or adjacent to table 16 of the machine tool as shown in FIGS. 1 and 2, to engage feed position adjustment nut 118 on the outside of the tool holder and then the spindle must be rotated by the proper amount to effect the desired adjustment. The wedge angle of the tool and ratio of the internal gearing, or a factor representative of these values will be needed to accurately calculate the proper rotation angle.

Depending on a number of factors, the tool holder with tool installed may be large enough that it may not be able to be kept in the tool magazine of the machine tool if present. It may need to reside in a nest on the table that is away from the work piece but reachable by the spindle. Such a nest could be designed to include the parallel planes 142 to always engage the nut on the tool holder, so that any tool size compensation could be made by a programmed spindle rotation just after it has grasped the tool holder but before it has removed it from its nest.

Advantages

Advantages of the tool holder of the invention as embodied by tool holder 20 include that the tool holder has an integral system for sensing a final feed position and sending a signal immediately when that position is reached. The feed position is equivalent to the wedge position in the honing tool and therefore implies a consistent final bore size. When used with honing elements such as abrasive stones that have minimal or consistent stone wear, this will produce close bore size control.

The tool holder's connection to the honing tool is identical to a honing machine spindle so that any tools may be used interchangeably in a honing machine or any other machine tool equipped with this tool holder.

This honing tool holder does not require a machine tool that is capable of providing through-the-spindle coolant with variable and controlled pressure.

As the abrasive stones or other honing elements wear, the internal feed rod must be adjusted.

As noted above, nut 118 on the outside of the tool holder can be turned relative to the body of the tool holder to lengthen or shorten the effective length of the internal feed rod, e.g., using parallel planes 142. This will be accomplished by programmed motion of the machine tool which will set the tool holder into a "nest" that mates with nut 118, illustrated in FIGS. 1 and 2. (E.g. like a traditional open-end wrench fixed to some location on the machine tool table.) The machine tool will then rotate the spindle (with the tool holder) by a precise angle corresponding to the amount of feed adjustment required. As another advantage, a "window" in the side of the tool holder exposes LED 94 (visible or infrared) or a radio frequency transmitter. When the internal feed rod reaches a position corresponding with the final bore size, a change of state of the switch will be made and a signal will be transmitted. A receiver connected to the machine tool control system will use this signal as a trigger to stop the honing cycle.

In light of all the foregoing, it should thus be apparent to those skilled in the art that there has been shown and described a novel tool holder for a honing tool with an in-process feed adjusting capability. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A honing tool holder, comprising a body having a mounting element for cooperatively mounting the tool holder on a spindle of a machine tool for rotation therewith about a rotational axis therethrough and axial stroking movements, and a tool holding element opposite the mounting element configured and operable to cooperatively hold a honing tool for rotation about the rotational axis; and a feed system carried entirely on the body, comprising a feed rod assembly supported for axial movement within the body and configured to connect to a feed element of a honing tool when held by the tool holding element, to control radial movements of honing elements of the tool, and a centrifugal force operated mechanism cooperatively engageable with an element of or connected to the feed rod assembly and operable to control at least an initial axial movement thereof, the centrifugal force operated mechanism including at least one weight restrained for radial movement only, including radial outward movement to allow the axial movement of the element of the feed rod assembly, and at least one biasing element disposed to move the at least one weight radially inwardly when the centrifugal force is reduced.

2. The honing tool holder of claim 1, wherein the feed system further comprises at least one roller bearing to reduce friction between the at least one weight and an adjacent element restraining the at least one weight for the radial movement only.

3. The honing tool holder of claim 1, wherein the at least one biasing element comprises a radially extendable spring.

4. The honing tool holder of claim 1, wherein the feed system further comprises an external element on the body having opposite radially outwardly facing flat surfaces and connected by gears within the body to the feed rod assembly such that axial rotation of the body relative to the external element will change a position of an element disposed to limit the axial movement of the feed rod assembly.

5. The honing tool holder of claim 4, wherein the element on the body is supported thereon generally about the tool holding element for relative axial rotation therebetween.

6. The honing tool holder of claim 4, further comprising a signal unit carried on the body and including a circuit including at least a battery, a switch, and a signal device, the switch being positioned and operable to connect the battery to the signal device to activate the signal device to output a signal when the feed rod assembly reaches the limit.

7. The honing tool holder of claim 6, wherein the signal comprises a light emission.

8. The honing tool holder of claim 6, wherein the signal comprises an RF emission.

9. The honing tool holder of claim 1, wherein the feed system includes at least one biasing element disposed to urge the feed rod assembly in an axial direction to exert a feed force against the feed element of the honing tool when held by the tool holding element, the mounting element comprises a tapered shank installable in a collet of a spindle, and the tool holder comprises a feed force actuator including an element extending radially from the shank and biased radially outwardly but movable radially inwardly into the collet and against the at least one biasing element to increase the feed force.

10. The honing tool holder of claim 9, wherein the feed system includes an external element on the body movable in a predetermined manner relative thereto, the external element being connected to the feed rod assembly by at least one gear such that movement of the external element in the predetermined manner will rotate the gear to change the feed force.

11. The honing tool holder of claim 1, comprising at least one restraining pin extending into at least one of the weights and into another element within the tool holder and removable therefrom to change a force exerted against the feed rod assembly.

12. A honing tool holder, comprising:

a body having a mounting element for cooperatively mounting the tool holder on a spindle of a machine tool for rotation therewith about a rotational axis through the spindle and movement along the axis, and a tool holding element opposite the mounting element configured and operable for cooperatively holding a honing tool for rotation about the rotational axis;

a feed system carried on the body, configured to connect to a feed element of a honing tool held by the tool holding element, the feed system including at least one biasing element configured and operable to automatically exert a feed force against the feed element to urge a honing element of the tool radially outwardly relative to the tool only after generation of a centrifugal force by initial rotation of the tool holder by the spindle, and the feed system including a feed force mechanism including an internal adjustment element exposed to the exterior of the body and movable in a predetermined manner by an externally applied force relative to the body to adjust the feed force;

wherein the feed system further comprises a weight restrained for radial movement only, configured to be moved radially outwardly by the centrifugal force generated by the initial rotation of the tool holder by the spindle to initiate the exertion of the feed force against the feed element.

13. The honing tool holder of claim 12, wherein the feed system further comprises at least one biasing element disposed to urge the at least one weight radially inwardly.

14. The honing tool holder of claim 12, wherein the feed system further comprises at least one roller bearing to reduce friction between the at least one weight and an adjacent element restraining the at least one weight for the radial movement only.

15. The honing tool holder of claim 12, wherein the feed system comprises a feed rod assembly supported for axial movement within the body and configured to engage the at least one biasing element and to connect to a feed element of a honing tool when held by the tool holding element to communicate the feed force thereto, and a signal unit carried on the body and including a circuit including at least a battery, a switch, and a signal device, the switch being positioned and operable to connect the battery to the signal device to activate the signal device to output a signal when the feed rod assembly reaches a limit.

16. The honing tool holder of claim 15, wherein the signal comprises a light emission.

17. The honing tool holder of claim 15, wherein the signal comprises an RF emission.

18. A honing tool holder, comprising a body having a mounting element for cooperatively mounting the tool holder on a spindle of a machine tool for rotation therewith about a rotational axis therethrough and axial stroking movements, and a tool holding element opposite the mounting element holding a honing tool for rotation about the rotational axis; and a feed system carried entirely on the body, comprising a feed rod assembly supported for axial movement within the body and connected to a feed element of the honing tool to control radial movements of honing elements of the tool, and a centrifugal force operated mechanism cooperatively engaged with an element of the feed rod assembly to control at least an initial axial movement thereof, the centrifugal force operated mechanism including at least one weight restrained for radial movement only, including radial outward movement to allow the axial movement of the element of the feed rod assembly, and at least one biasing element connected to the at least one weight to move the at least one weight radially inwardly when the centrifugal force is reduced.

19. The honing tool holder of claim 18, comprising at least one restraining pin extending into at least one of the weights and into another element within the tool holder and removable therefrom to change a force exerted against the feed rod assembly.

* * * * *